US008893646B2

(12) United States Patent
Ando et al.

(10) Patent No.: US 8,893,646 B2
(45) Date of Patent: Nov. 25, 2014

(54) LIQUID APPLICATION APPARATUS

(75) Inventors: Takashi Ando, Aikoh-gun (JP); Eijiro Furuta, Aikoh-gun (JP); Shinpei Kakiuchi, Aikoh-gun (JP)

(73) Assignee: NHK Spring Co., Ltd., Kanagawa (JP)

( * ) Notice: Subject to any disclaimer, the term of this patent is extended or adjusted under 35 U.S.C. 154(b) by 720 days.

(21) Appl. No.: 12/881,803

(22) Filed: Sep. 14, 2010

(65) Prior Publication Data

US 2011/0061589 A1 Mar. 17, 2011

(30) Foreign Application Priority Data

Sep. 17, 2009 (JP) ..... 2009-215152

(51) Int. Cl.
*B05C 5/02* (2006.01)

(52) U.S. Cl.
CPC ..... *B05C 5/0216* (2013.01); *B05C 5/0254* (2013.01); *B05C 5/027* (2013.01); *B05C 5/0204* (2013.01); *Y10S 118/02* (2013.01)
USPC ..... 118/410; 118/429; 118/DIG. 2; 118/323

(58) Field of Classification Search
USPC ..... 118/323, 410, 411, 412, 429, DIG. 2; 427/286–288, 356; 156/244.11, 500, 156/578; 239/548, 556, 557, 565, 566, 589, 239/592; 222/478; 425/461–464
See application file for complete search history.

(56) References Cited

U.S. PATENT DOCUMENTS

| | | | | |
|---|---|---|---|---|
| 4,806,357 | A * | 2/1989 | Garrett et al. | 427/4 |
| 6,758,905 | B2 * | 7/2004 | Suzuki et al. | 118/300 |
| 8,171,973 | B2 * | 5/2012 | Ganzer et al. | 156/500 |
| 2001/0014536 | A1 * | 8/2001 | Nakamura et al. | 438/689 |
| 2002/0009536 | A1 * | 1/2002 | Iguchi et al. | 427/10 |
| 2002/0101460 | A1 | 8/2002 | Miyauchi et al. | |
| 2002/0121239 | A1 * | 9/2002 | Tonazzi et al. | 118/401 |

FOREIGN PATENT DOCUMENTS

| | | |
|---|---|---|
| JP | 2002-224604 | 8/2002 |
| JP | 2004-025121 | 1/2004 |

* cited by examiner

*Primary Examiner* — Laura Edwards
(74) *Attorney, Agent, or Firm* — Jordan and Hamburg LLP

(57) ABSTRACT

A liquid application apparatus applies a liquid to an objective region. The apparatus includes a trap having an opening from which the liquid linearly appears, a feeder to feed the liquid to the trap, and an operation unit to position the trap on the objective region and bring the linearly appeared liquid at the trap into contact with the objective region, thereby linearly applying the liquid to the objective region. The apparatus is capable of linearly applying the liquid in a uniform thickness to the objective region.

16 Claims, 9 Drawing Sheets

LIQUID APPLICATION APPARATUS

BACKGROUND OF THE INVENTION

1. Field of the Invention

The present invention relates to a liquid application apparatus for linearly applying a liquid such as a liquid adhesive or a liquid electronic material to an objective region.

2. Description of Related Art

An example of a liquid application apparatus for applying a liquid such as a liquid adhesive or a liquid electronic material to an objective region is a liquid discharging multinozzle for discharging a liquid from a plurality of discharge holes disclosed in Japanese Unexamined Patent Application Publication No. 2004-25121.

The multinozzle of this related art includes a discharge quantity adjuster arranged between a liquid inlet to which the liquid is supplied and the discharge holes for discharging the liquid. Based on relative diameters of the discharge holes or an arrangement of the discharge holes, the liquid quantity adjuster discharges a required quantity of the liquid from each of the discharge holes.

The multinozzle of the related art is capable of discharging a required quantity of a liquid adhesive or liquid electronic material from the discharge holes.

According to the related art, the discharge holes are independent of one another and a predetermined gap is present between adjacent ones of the discharge holes. When the multinozzle is used to linearly apply a liquid to an objective region, spots on the objective region facing the discharge holes receive a thick liquid and spots on the objective region not facing the discharge nozzles receive almost no liquid. Namely, the related art realizes a linear application of liquid as a collection of liquid spots and is unable to uniformly apply a liquid in a linear fashion.

SUMMARY OF THE INVENTION

An object of the present invention is to provide a liquid application apparatus capable of linearly applying a liquid in a uniform thickness to an objective region.

In order to accomplish the object, an aspect of the present invention provides a liquid application apparatus for applying a liquid to an objective region, including a trap having an opening from which the liquid linearly appears, a feeder configured to feed the liquid to the trap, and an operation unit configured to position the trap on the objective region and bring the linearly appeared liquid at the trap into contact with the objective region, thereby linearly applying the liquid to the objective region.

This aspect of the present invention is capable of linearly applying a liquid in a uniform thickness to an objective region.

DETAILED DESCRIPTION OF EMBODIMENTS

A liquid application apparatus according to an embodiment of the present invention will be explained in detail with reference to the drawings. The liquid application apparatus according to the present invention linearly applies a liquid in a uniform thickness to an objective region with the use of a trap having an opening from which the liquid linearly appears and operation unit positioning the trap on the objective region and bringing the linearly appeared liquid at the trap into contact with the objective region.

Figure 1:
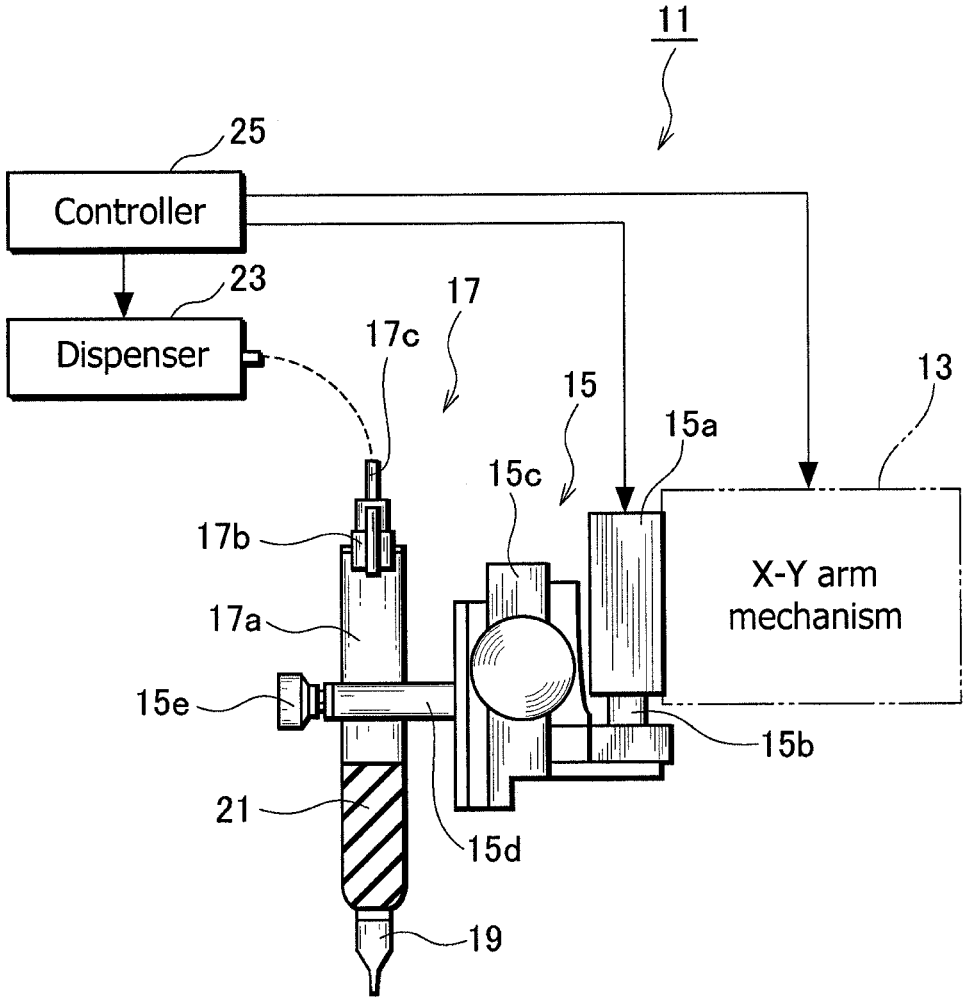
FIG. 1 is a front view generally illustrating a liquid application apparatus according to an embodiment of the present invention.

FIG. 1 generally illustrates a liquid application apparatus 11 according to an embodiment of the present invention. As illustrated in FIG. 1, the liquid application apparatus 11 has an X-Y arm mechanism 13, a Z-axis drive mechanism 15, and an application unit 17 serving as an operation unit.

Although not illustrated in FIG. 1, the X-Y arm mechanism 13 has an X-axis arm, a Y-axis arm, and a motor that drives the Y-axis arm along the X-axis arm and the Z-axis drive mechanism 15 along the Y-axis arm.

A controller 25 provides a drive control signal to drive the motor of the X-Y arm mechanism 13 and move the application unit 17 to a specified position on X- and Y-axes.

The Z-axis drive mechanism 15 has, from the X-Y arm mechanism 13 side, a base 15*a*, a rod 15*b*, an intermediate support 15*c*, a rod 15*d*, and a stopper 15*e*.

The base 15*a* is supported so that it is movable relative to the X-Y arm mechanism 13 and is provided with a Z-axis motor (not illustrated) to move the rod 15*b* along a Z-axis.

The rod 15*b* transfers a motion of the Z-axis motor to the intermediate support 15*c* and rod 15*d*.

In response to a drive signal from the controller 25, the Z-axis motor drives the Z-axis drive mechanism 15, to move the application unit 17 to a specified position on the Z-axis.

The application unit 17 has a cylindrical syringe 17*a*, a lid 17*b* at an upper end of the syringe 17*a*, a tube 17*c*, and an application head 19 detachably attached to a lower end of the syringe 17*a*. The application unit 17 is vertically oriented along the Z-axis and is fixed to the rod 15*d* with the stopper 15*e*.

The syringe 17*a* contains a liquid (for example, an adhesive) 21 to be linearly applied to an objective region. The adhesive 21 is discharged from a lower end of the application head 19 with compressed air sent from a dispenser 23 into the syringe 17*a* through the tube 17*c*. The adhesive 21 is selected from appropriate adhesives including a thermosetting adhesive, an ultraviolet curing adhesive, an anaerobic curing adhesive, a conductive adhesive, and a nonconductive adhesive.

The tube 17*c* is connected to the lid 17*b* and dispenser 23, to feed compressed air from the dispenser 23 into the syringe 17*a*. The dispenser 23 is connected to the controller 25, and in response to a drive control signal from the controller 25, feeds compressed air into the syringe 17*a*. With the compressed air fed into the syringe 17*a*, the application head 19 linearly applies the adhesive 21 to an objective region.

The application head 19 that is an essential part of the liquid application apparatus according to the embodiment will be explained.

Figure 2A:
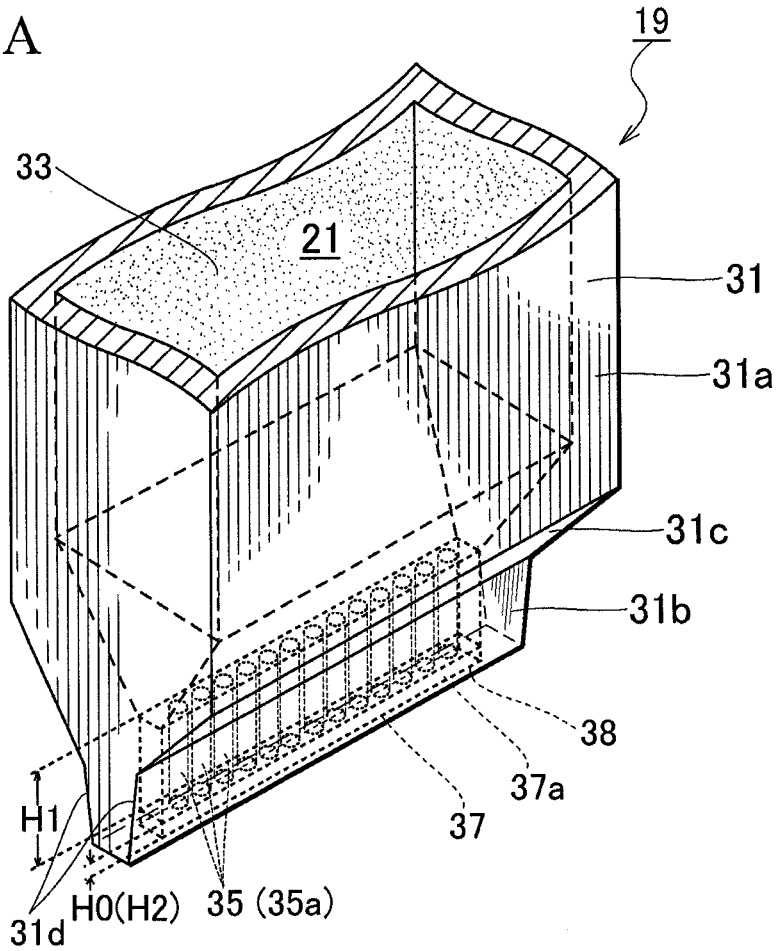
FIG. 2A is a perspective view illustrating an application head of the liquid application apparatus of FIG. 1.
Figure 2B:
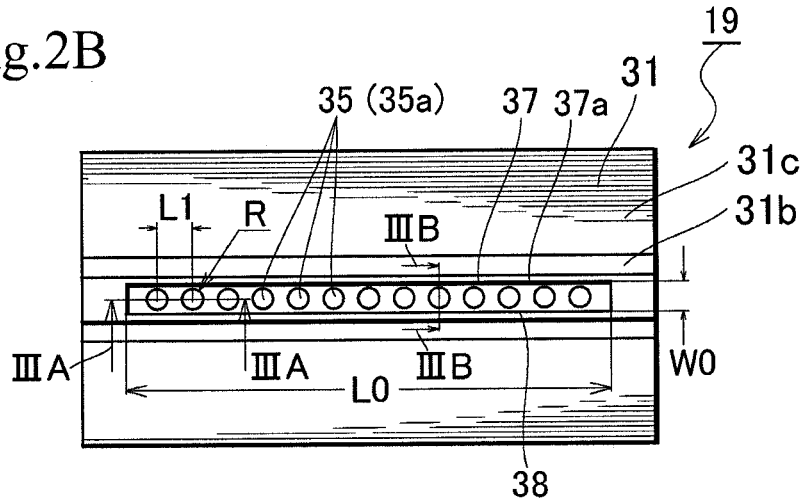
FIG. 2B is a bottom view illustrating the application head of FIG. 2A.
Figure 3A:
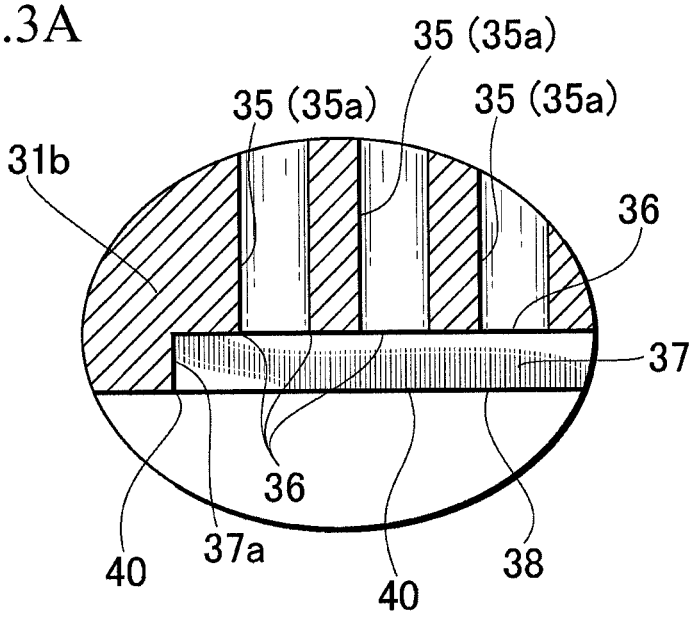
FIG. 3A is an enlarged sectional view taken along a line IIIA-IIIA of FIG. 2B.
Figure 3B:
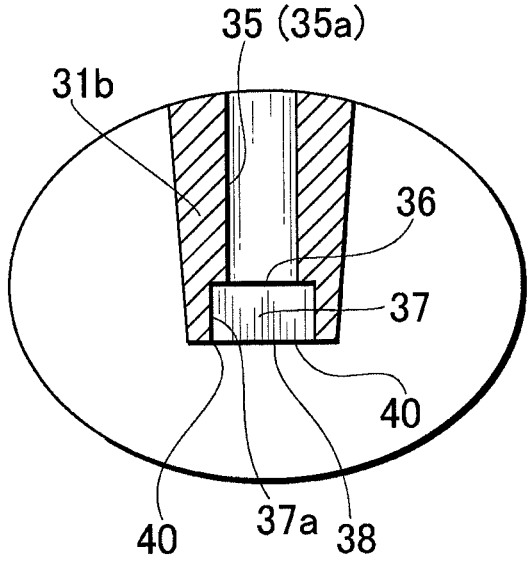
FIG. 3B is an enlarged sectional view taken along a line IIIB-IIIB of FIG. 2B.
Figure 4A:
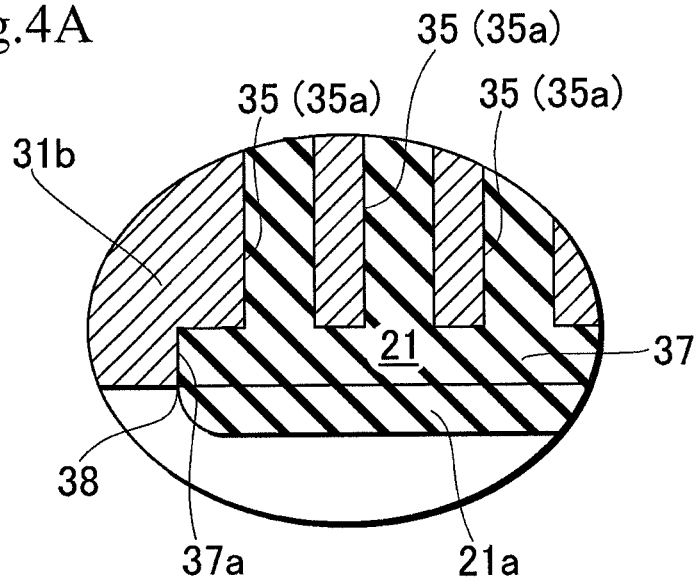
FIG. 4A is a view corresponding to FIG. 3A with a linearly trapped liquid.
Figure 4B:
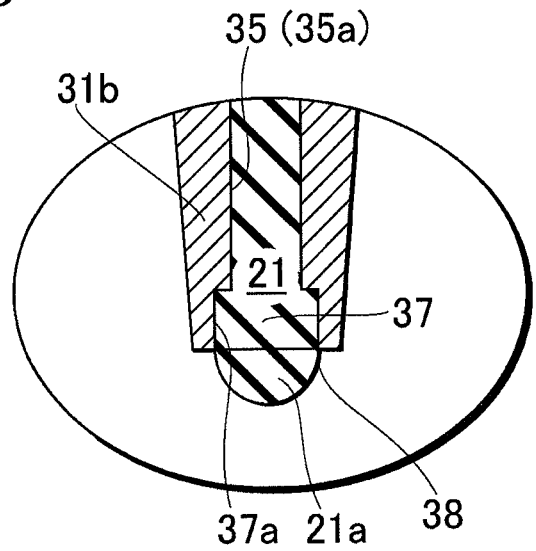
FIG. 4B is a view corresponding to FIG. 3B with a linearly trapped liquid.

FIG. 2A is a perspective view illustrating the application head 19, FIG. 2B is a bottom view of the application head 19, FIG. 3A is an enlarged sectional view taken along a line IIIA-IIIA of FIG. 2B, FIG. 3B is an enlarged sectional view taken along a line IIIB-IIIB of FIG. 2B, FIG. 4A is a view corresponding to FIG. 3A with a linearly trapped liquid, and FIG. 4B is a view corresponding to FIG. 3B with a linearly trapped liquid.

The application head 19 linearly applies the liquid (adhesive) 21 to an objective region.

To correctly achieve the liquid linear application, the application head 19 has a box-like casing 31, a tank 33, a plurality of guides 35, and a trap 37 as illustrated in FIGS. 2A and 2B.

The casing 31 is made of, for example, metal such as stainless steel, or synthetic resin. The casing 31 has an upper casing portion 31*a* having a predetermined width and a lower casing portion 31*b* narrower than the upper casing portion 31*a*. A pair of slant faces 31*c* connects the upper casing portion 31*a* to the lower casing portion 31*b*. The lower casing portion 31*b* has a pair of slant outer faces 31*d* that gradually narrows the lower casing portion 31*b* in a downward direction.

The tank 33 is defined in an inner space of the casing 31 and temporarily stores the adhesive 21.

As illustrated in FIGS. 2A to 3B, the guides 35 are arranged side by side, to evenly guide the adhesive 21 from the tank 33 to the trap 37.

The guides 35 each are a through hole 35*a* formed from the tank 33 to the trap 37 and are arranged side by side in the lower casing portion 31*b*. The guides 35 are uniformly formed and each have a cylindrical shape with an inner diameter R of, for example, about 0.05 to 0.15 mm and a height H1 of, for example, about 0.1 to 0.5 mm, so that the adhesive 21 in the guides 35 receives an equal flow resistance between the tank 33 and the trap 37. As a result, the adhesive 21 is uniformly discharged from the guides 35 into the trap 37.

The guides 35 are arranged at regular intervals L1 (for example, about 0.2 to 0.3 mm). The intervals L1 among the guides 35 are preferable to be as small as possible, to equalize a height H2 of a linearly appearing liquid in a length (L0) direction in the trap 37.

The tank 33 and guides 35 form a feeder feeding the adhesive 21 to the trap 37. An operation unit positioning the trap 37 on the objective region and bringing the linearly appeared adhesive 21 at the trap 37 into contact with the objective region corresponds to the controller 25, mechanisms 13 and 15, and the like.

Each guide 35 has an angular edge 36 on the opening edge around the opening. The angular edge 36 has about a right angle defined by an inner peripheral surface of the guide 35 and an upper surface of the channel 37*a* of the trap 37 to explained next.

The trap 37 linearly holds the adhesive 21 passed through the guides 35. The trap 37 is a rectangular parallelepiped channel 37*a* having an opening 38 that faces an objective region to which the adhesive 21 is to be applied. As illustrated in FIGS. 3A and 3B, the trap 37 is properly designed to linearly trap droplets of the adhesive 21 with a width W0 (for example, about 1 to 2 mm), a height H0 (for example, about 0.3 to 1 mm), and a length L0 (for example, 1 to 5 mm). With these dimensions, the liquid 21 linearly appears from the opening 38 of the trap 37 along a longitudinal direction of the trap 37.

The width W0, height H0, and length L0 of the trap 37 are properly determined according to various factors such as a viscosity of the adhesive 21 and an applied quantity of the adhesive 21.

The trap 37 has an angular edge 40 on the opening edge around the opening 38 of the channel 37*a*. The angular edge 40 has about a right angle defined by the circumferential face of the channel 37*a* and the lower surface of the lower casing portion 31*b*.

At the trap 37, the linearly trapped adhesive 21 demonstrates intermolecular force and surface tension against gravity. As a result, the linearly trapped liquid 21 in the channel 37*a* of the trap 37 produces a dome-like dangling part 21*a* protruding from the opening 38 of the trap 37, as illustrated in FIGS. 4A and 4B. The dome-like shape is a surface shape formed by connecting even tension points on the linear liquid 21. The dangling part 21*a* comes in contact with an objective region, so that the liquid 21 is linearly applied to the objective region.

It is preferable that a circumferential face of the channel 37*a* and a peripheral area of the opening 38 are processed to have repellence, so that the liquid (adhesive) in the trap 37 may easily separate therefrom without causing a stringing phenomenon that frequently occurs when the liquid has a low viscosity. The repellence also helps precisely adjusting an applied quantity of the liquid. When the objective region is on a head suspension 41 (to be explained later) illustrated in FIGS. 5A and 5B, the liquid is usually an adhesive having a high viscosity that hardly causes the stringing phenomenon.

To surely hold the liquid 21 in the trap 37, the channel 37*a* may have a lattice or net member (not illustrated).

When the casing 31 is made of metal such as stainless steel, the tank 33, guides 35, and trap 37 may be made by cutting and perforating the metal.

When the casing 31 is made of synthetic resin, the tank 33, guides 35, and trap 37 may be made by insert forming with a mold having a predetermined shape.

The liquid application apparatus 11 according to the embodiment is applicable to any work on which an objective region to linearly apply a liquid is defined.

Figure 5A:
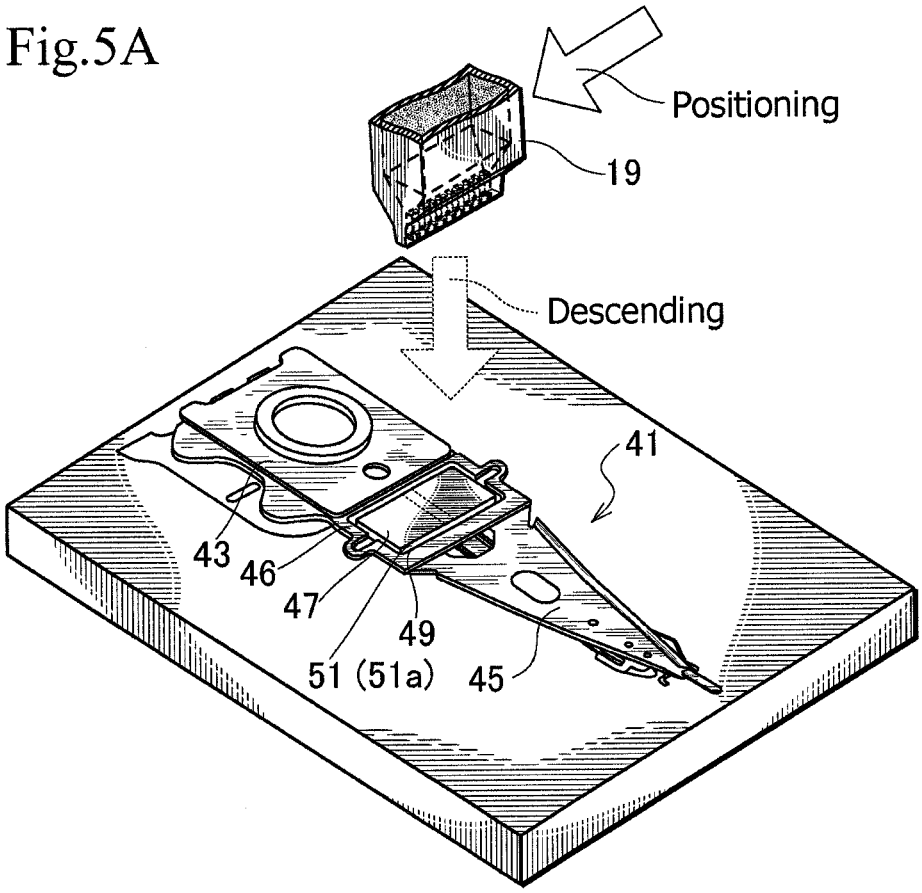
FIG. 5A is a perspective view illustrating the application head positioned above an objective region on a work.
Figure 5B:
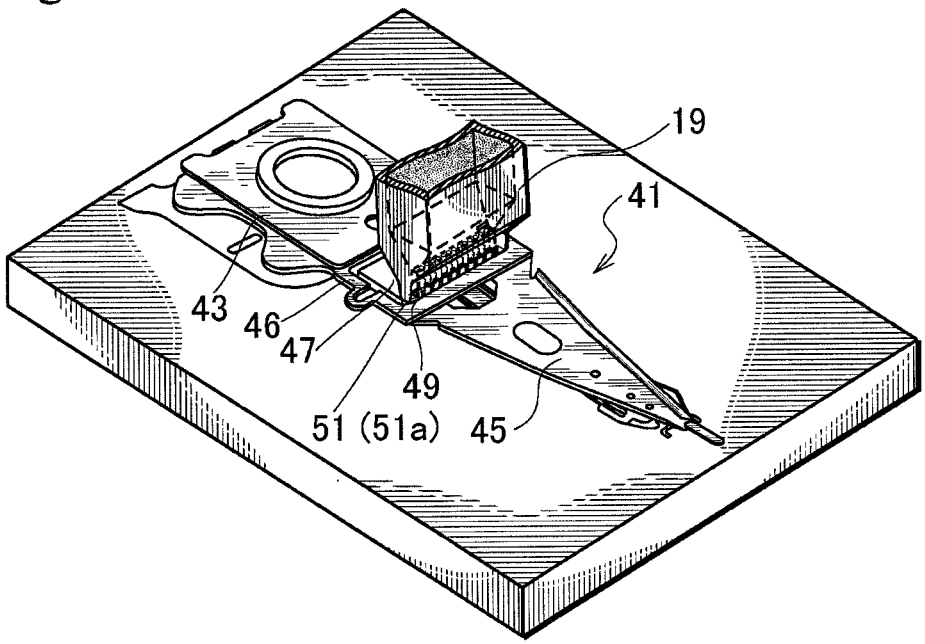
FIG. 5B is a perspective view illustrating the application head brought into contact with the objective region.

As an example of such a work to which the liquid application apparatus 11 is applied, FIGS. 5A and 5B illustrate a half-finished head suspension 41, in which FIG. 5A is a perspective view illustrating the application head 19 of the liquid application apparatus 11 positioned above an objective region on the head suspension 41 and FIG. 5B is a perspective view illustrating the application head 19 brought into contact with the objective region on the head suspension 41.

The head suspension 31 illustrated in FIGS. 5A and 5B is used to read/write information in a magnetic disk drive (not illustrated) and has a base plate 43, a load beam 45, an actuator base 46, and the like.

The base plate 43 resiliently supports the load beam 45 through the actuator base 46 and is made of a metal thin plate such as a stainless steel plate having a thickness of, for example, about 150 to 200 μm.

The load beam 45 applies load onto a magnetic head slider (not illustrated) arranged at a front end of the load beam 45. The load beam 45 is resilient and is made of a metal thin plate such as a stainless steel plate having a thickness of, for example, about 50 to 150 μm.

The actuator base 46 is interposed between the base plate 43 and the load beam 45 and supports a piezoelectric element 47 that deforms in a compressed manner when receiving a voltage. The actuator base 46 may be integral with or separated from the base plate 43.

The half-finished head suspension 41 has an opening 49 formed through the actuator base 46 and a receiver 49*a* (FIG. 6B) inwardly protruding from a lower end of the opening 49, to receive a lower electrode of the piezoelectric element 47.

A liquid application operation of the liquid application apparatus 11 according to the embodiment will be explained.

According to the embodiment, the application operation is carried out to attach the piezoelectric element 47 to the opening 49 and is executed in two steps.

Figure 6A:
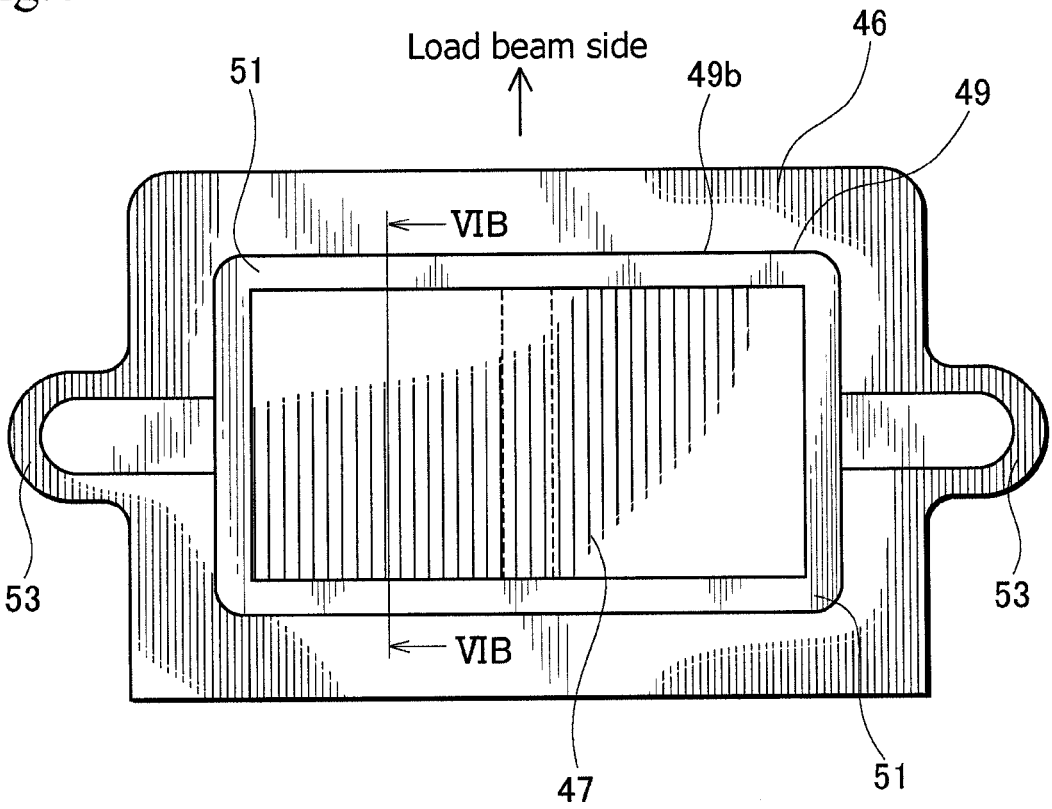
FIG. 6A is a plan view illustrating an actuator base of the work on which the objective region is defined.
Figure 6B:
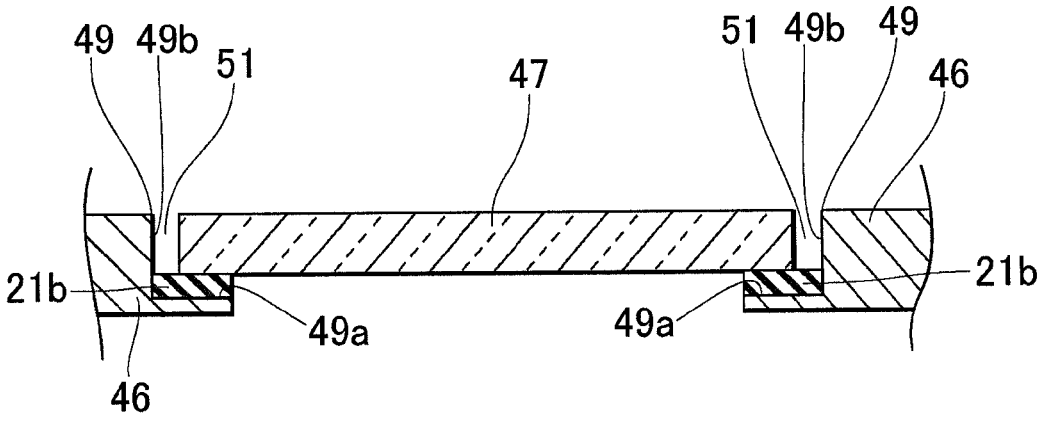
FIG. 6B is a sectional view taken along a line VIB-VIB of FIG. 6A.

In the first step, a liquid, i.e., a nonconductive adhesive 21*b* is linearly applied to the receiver 49*a* and the piezoelectric element 47 is placed on the adhesive 21*b*, so that the piezoelectric element 47 is attached to the receiver 49*a* through the adhesive 21*b* (FIG. 6B).

In the second step, a liquid nonconductive adhesive is linearly applied into a rectangular gap 51 between a circumferential edge 49*b* of the opening 49 and a circumferential side face of the piezoelectric element 47, so that the gap 51 is filled with the adhesive and the piezoelectric element 47 is fixed to the opening 49 through the adhesive.

To achieve the first and second steps, the application head 19 is first positioned on an objective region in the opening 49, as illustrated in FIG. 5A. Thereafter, the application head 19 is moved closer to, i.e., is lowered onto the objective region, as illustrated in FIGS. 5A and 5B. Then, the dangling part 21*a* (FIG. 4B) of the adhesive 21 protruding from the opening 38 of the trap 37 comes in contact with the objective region. As a result, the adhesive 21 is applied to the objective region linearly dependent on the linear appearance of the adhesive 21 on the trap 37.

After the two steps mentioned above, the half-finished head suspension 41 becomes a finished product having a function of displacing the front end of the load beam 45 in a sway direction in response to a deformation of the piezoelectric element 47.

In this way, the liquid application apparatus 11 according to the embodiment has the trap 37 having the opening 38 from which the liquid 21 linearly appears, the feeder to feed the liquid 21 to the trap 37, and the operation unit to position the trap 37 on an objective region and bring the linearly appeared liquid at the trap 37 into contact with the objective region, thereby linearly applying the liquid 21 to the objective region.

The trap 37 is the channel 37*a* and the opening 38 faces the objective region. The operation unit brings a dangling part 21*a* of the liquid 21, which is linearly trapped in the channel 37*a* and dangles from the opening 38, into contact with the objective region, thereby linearly applying the liquid 21 to the objective region.

The liquid application apparatus 11 according to the embodiment, therefore, can linearly apply a liquid in a uniform thickness to an objective region.

The feeder includes the tank 33 to store the liquid 21 and the guides 35 to guide the liquid 21 from the tank 33 to the trap 37. This configuration correctly supplies the liquid to the trap 37 and applies the liquid to the objective region.

The guides 35 each are a cylindrical part and the cylindrical parts have the same inner diameter R and the same length H1. The guides 35 are arranged at regular intervals. This configuration equalizes the height H2 of a linearly formed liquid in a length (L0) direction in the trap 37.

Accordingly, the embodiment can evenly and linearly apply the liquid in a correct quantity to the objective region.

The trap 37 is processed to have repellence, so that the liquid (adhesive) in the trap 37 easily separates therefrom in a correct quantity without causing a stringing phenomenon.

An application head of a liquid application apparatus according to a modification of the above-mentioned embodiment will be explained with reference to FIGS. 6A to 7B. According to the above-mentioned embodiment, the objective region into which the liquid (nonconductive adhesive) 21 is applied is rectangular as illustrated in FIGS. 6A and 6B. The application head 55 according to the modification is appropriate to uniformly apply a liquid in a correct quantity to such a rectangular objective region.

Figure 7A:
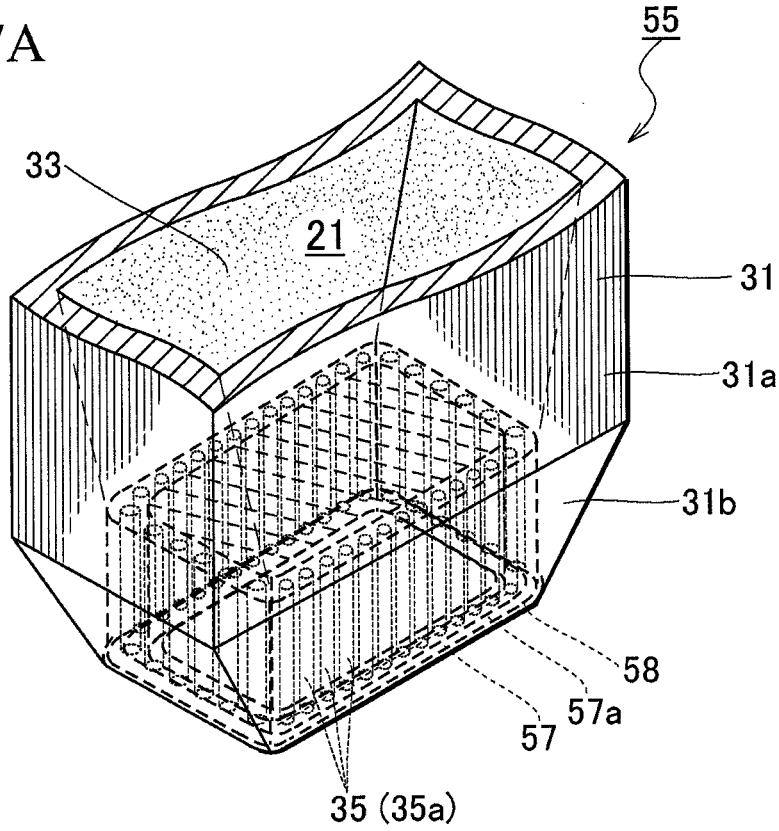
FIG. 7A is a perspective view illustrating an application head of a liquid application apparatus according to a modification of the embodiment of FIG. 2A.
Figure 7B:
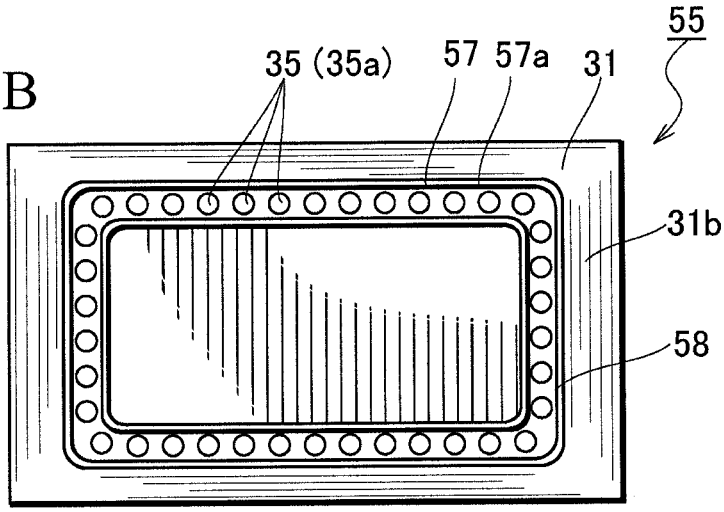
FIG. 7B is a bottom view illustrating the application head of FIG. 7A

FIG. 6A is a plan view illustrating the actuator base 46 on which an objective region is defined to linearly apply a liquid thereto, FIG. 6B is a sectional view taken along a line VIB-VIB of FIG. 6A, FIG. 7A is a perspective view illustrating the application head 55 according to the modification, and FIG. 7B is a bottom view illustrating the application head 55.

After the first step of the above-mentioned embodiment, the rectangular gap 51 (FIGS. 6A and 6B) is present between the circumferential edge 49*b* of the opening 49 and the circumferential side face of the piezoelectric element 47 fixed to the receiver 49*a*. In FIG. 6A, the actuator base 46 has a pair of flexible links 53 each having a U-shape on a side thereof. The flexible links 53 function to improve rigidity around the actuator base 46.

The modification is basically the same as the above-mentioned embodiment and is characterized by the application head 55. The following explanation of the modification will mainly be made in connection with the application head 55. Like the application head 19 of the embodiment, the application head 55 of the modification is detachably attached to a lower end of the syringe 17*a* (FIG. 1).

According to the embodiment, the application head 19 has the trap 37 that is linear.

According to the modification, the application head 55 has a trap 57 that is rectangular corresponding to the rectangular gap 51 into which the liquid 21 is applied as illustrated in FIGS. 7A and 7B. The rectangular trap 57 is capable of simultaneously filling the gap 51 with the liquid (nonconductive adhesive) 21. In this way, the application head 55 of the modification has the trap 57 different from the trap 37 of the embodiment in the shape.

The trap 57 has a channel 57*a* whose shape is the same as the rectangular gap 51. The channel 57*a* of the trap 57 linearly holds the liquid 21 in each side of the rectangular shape. In the trap 57, the linearly trapped liquid (nonconductive adhesive) 21 demonstrates intermolecular force and surface tension against gravity. As a result, the linearly trapped liquid 21 in the channel 57*a* of the trap 57 produces a dome-like dangling part protruding from an opening 58 of the trap 57. The dangling part has the same shape as the rectangular gap 51. The dangling part is brought into contact with the gap 51, to apply the liquid 21 to the gap 51 dependent on the rectangular appearance of the adhesive 21 on the trap 57.

When filling the gap 51 with the liquid (nonconductive adhesive) 21, the opening 58 of the trap 57 is inserted into the gap 51 up to the liquid (nonconductive adhesive) 21*b* already applied to and cured on the receiver 49*a* (FIG. 6B). With the opening 58 of the application head 55 inserted in the gap 51, the dispenser 23 (FIG. 1) feeds compressed air into the syringe 17*a*, so that the liquid (nonconductive adhesive) 21 is forcibly fed from the trap 57 into the gap 51 and fills the gap 51.

According to the modification, the trap 57 of the application head 55 of the liquid application apparatus has the same shape as the rectangular gap 51, and therefore, can apply the liquid (nonconductive adhesive) 21 to the gap 51, or fill the gap 51 with the liquid 21 at once.

According to the modification, the trap 57 of the application head 55 is rectangular. This configuration does not limit the present invention. The present invention can employ a trap of any shape depending on the shape of an objective region to which a liquid is applied.

Figure 8A:
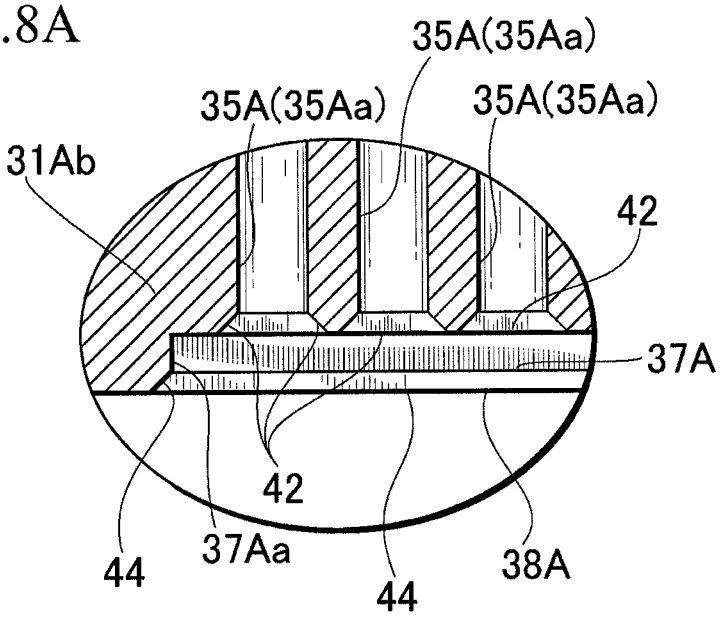
FIG. 8A is an enlarged sectional view illustrating an application head of a liquid application apparatus according to another modification of the embodiment of FIG. 2A and taken along the line IIIA-IIIA of FIG. 2B.
Figure 8B:
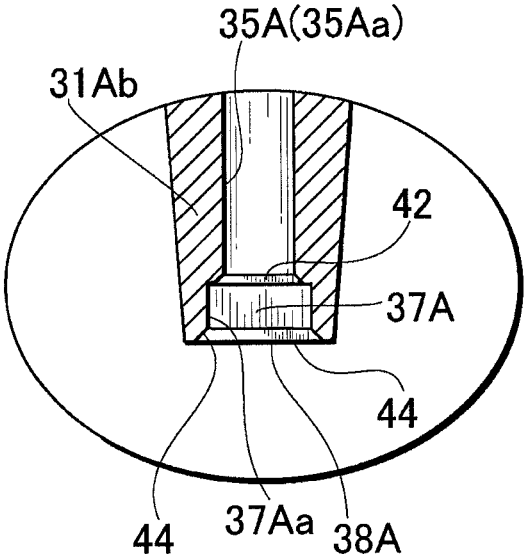
FIG. 8B is an enlarged sectional view illustrating the modification of FIG. 8A and taken along the line IIIB-IIIB of FIG. 2B.
Figure 9A:
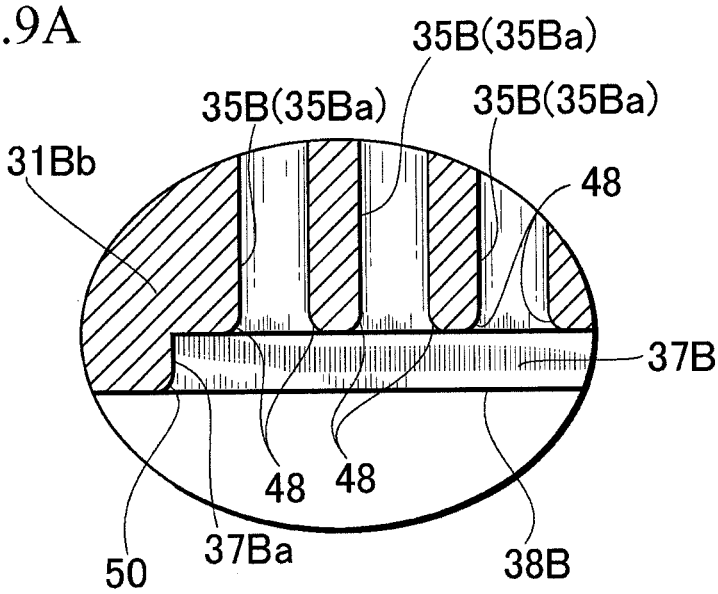
FIG. 9A is an enlarged sectional view illustrating an application head of a liquid application apparatus according to still another modification of the embodiment of FIG. 2A and taken along the line IIIA-IIIA of FIG. 2A.
Figure 9B:
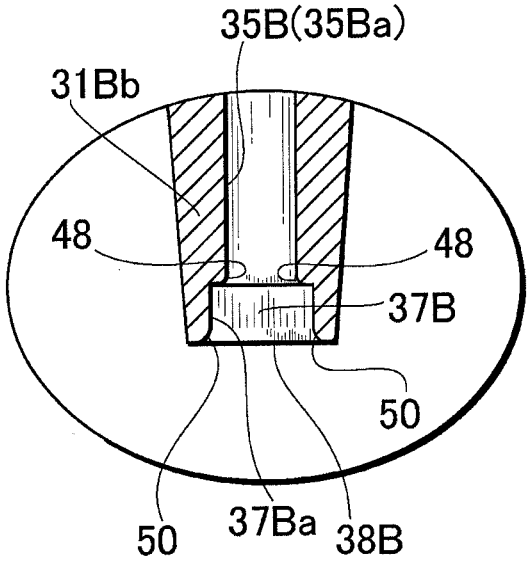
FIG. 9B is an enlarged sectional view illustrating the modification of FIG. 9A and taken along the line IIIB-IIIB of FIG. 2B.

Application heads of liquid application apparatuses according to modifications of the above-mentioned embodiment will be explained with reference to FIGS. 8A to 9B. FIGS. 8A and 8B illustrate an application head of a liquid application apparatus according to another modification of the embodiment of FIG. 2A in which FIG. 8A is an enlarged sectional view taken along the line IIIA-IIIA of FIG. 2B and FIG. 8B is an enlarged sectional view taken along the line IIIB-IIIB of FIG. 2B. FIGS. 9A and 9B illustrate an application head of a liquid application apparatus according to still another modification of the embodiment of FIG. 2A in which FIG. 9A is an enlarged sectional view taken along the line IIIA-IIIA of FIG. 2A and FIG. 9B is an enlarged sectional view taken along the line IIIB-IIIB of FIG. 2B.

The modifications are basically the same as to the embodiment of FIG. 2, and therefore, common parts are represented with the same reference marks or the same reference with "A" or "B" as those used in the first embodiment and parts characteristic to the modifications will mainly be explained.

According to the modifications illustrated in FIGS. 8A to 9B, guide faces are formed to the opening edges of the guides and the trap of the application head according to the embodiment of FIG. 2A to guide the liquid (nonconductive adhesive) 21.

The modification illustrated in FIGS. 8A and 8B has a tapered face 42 as the guide face formed on an opening edge of each guide 35A and a tapered face 44 as the guide face formed on an opening edge of a trap 37A.

The tapered face 42 of the guide 35A is formed between the inner peripheral surface of the guide 35A and the upper surface of the channel 37Aa of the trap 37A. The tapered face 42 gradually increases the diameter of the opening edge of the guide 35A toward the trap 37A.

The tapered face 44 of the trap 37A is formed between the circumferential face of the channel 37Aa and the lower surface of the lower casing portion 31Ab. The tapered face 44 gradually increases the sectional area of the channel 37Aa toward the opening 38A in both the longitudinal and lateral directions.

The modification illustrated in FIGS. 9A and 9B forms curved faces 48 and 50 as the guide faces instead of the tapered faces 42 and 44 of the modification of FIGS. 8A and 8B. The curved face 48 has a predetermined curvature and is formed on an opening edge of each guide 35B. The tapered face 50 has a predetermined curvature and is formed on an opening edge of a trap 37B.

According to the modifications of FIGS. 8A to 9B, the tapered face 42 and the curved face 48 guide the liquid 21 from the guides 35A and 35B to the traps 37A and 37B, respectively. As this result, the liquid 21 spreads to the whole traps 37A and 37B to be surely held by the traps 37A and 37B linearly.

With the tapered face 44 and curved face 50 of the traps 37A and 38B, the liquids in the traps 37A and 37B are guided and easily separate from the traps 37A and 37B in a correct quantity without causing a stringing phenomenon.

In this connection, one of the tapered faces 42 and 44 and one of the curved faces 48 and 50 may be formed and the others thereof may be omitted. The tapered faces 42 and curved faces 48 may be formed on some of the guides 35A and 35B, respectively. It may employ a combination the tapered face formed on one or more opening edges of the guides and the curved face formed on the remainder.

It may employ a combination of a tapered face formed on one of the opening edges of each guide and trap and a curved face formed on the other thereof.

Further, the sectional shapes of the modifications of FIGS. 8A to 9B are applicable to the modification of FIG. 7A. The present invention is not limited to the embodiment and modification mentioned above. Various modifications of the embodiment will be possible based on the teachings of the claims and specification without departing from the gist and scope of the present invention. Liquid application apparatuses according to such modifications also fall in the scope of the present invention.

According to the embodiment, an object to which the liquid application apparatus applies a liquid is the half-finished head suspension 41. This does not limit the present invention. The liquid application apparatus according to the present invention is applicable to any object to which a liquid is applied.

According to the embodiment, the liquid applied by the liquid application apparatus to an objective region is an adhesive. This does not limit the present invention. The liquid application apparatus according to the present invention is applicable to any liquid to be applied to an objective region.

According to the embodiment, the liquid 21 is guided from the tank 33 to the trap 37 through the guides 35 that are separated from one another. This does not limit the present invention. Adjacent ones of the guides 35 may communicate with each other.

According to the embodiment, the trap is linear or rectangular. This does not limit the present invention. According to the present invention, the trap may have any linear shape including a curved shape and a zigzag shape.

What is claimed is:

1. A liquid application apparatus for applying a liquid to an objective region, comprising:

an upper casing portion and a single lower casing portion that is connected to the upper casing portion;

a trap formed as a single channel having an opening on a lower surface of the lower casing portion, the opening being from which the liquid linearly appears;

a feeder feeding the liquid to an inside of the single channel of the trap; and an operation unit configured to position the trap on the objective region and bring the linearly appeared liquid at the trap into contact with the objective region, thereby linearly applying the liquid to the objective region; and wherein the feeder includes a tank defined in an upper space of the upper casing portion to store the liquid and a plurality of guides within the single lower casing portion, each one guide of the plurality of guides being arranged side by side as a hole through the single lower casing portion having a cylindrical shape, the hole having a first opening at a first end in direct communication with the tank and linearly extending to a second opening at a second end, opposite the first end, the second end being in direct communication with the single channel of the trap, said hole configured to guide liquid from the tank to the single channel of the trap; and wherein the opening of the single channel has an annular shape defined between an annular inner edge and an annular outer edge surrounding the annular inner edge on the lower surface of the lower casing portion so that the opening includes a plurality of linear opening sections that are annularly connected together.

2. The liquid application apparatus of claim 1, wherein the operation unit brings a dangling part of the liquid, which is linearly trapped in the channel and dangles from the opening, into contact with the objective region, thereby linearly applying the liquid to the objective region.

3. The liquid application apparatus of claim 1, wherein the plurality of guides have the same inner diameter and the same length.

4. The liquid application apparatus of claim 1, wherein the plurality of guides are arranged at regular intervals.

5. The liquid application apparatus of claim 1, wherein the trap is provided with repellence to the liquid.

6. The liquid application apparatus of claim 1, wherein the trap is formed into the same shape as the objective region.

7. The liquid application apparatus of claim 1, further comprising:

a guide face formed on an opening edge of the trap to guide the liquid.

8. The liquid application apparatus of claim 7, wherein the guide face is one of a tapered face and a curved face.

9. The liquid application apparatus of claim 1, wherein the second opening of said each one guide has an opening edge on which a guide face is formed to guide the liquid.

10. The liquid application apparatus of claim 9, wherein the guide face is one of a tapered face and a curved face.

11. The liquid application apparatus of claim 1, wherein the plurality of guides are respectively configured to apply equal flow resistance by said each one of the plurality of guides having a uniform cylindrical shape, a common height and a common diameter.

12. The liquid application apparatus of claim 1, wherein the opening of the single channel includes different types of the linear opening sections having different lengths.

13. The liquid application apparatus of claim 1, wherein the annular shape of the opening of the single channel is rectangular.

14. A liquid application apparatus for applying a liquid to an objective region, comprising:

an upper casing portion and a single lower casing portion that is connected to the upper casing portion;

a trap formed as a single channel having an opening on a lower surface of the lower casing portion, the opening being from which the liquid being applied linearly appears;

a feeder feeding the liquid to an inside of the single channel of the trap, the feeder comprising a tank defined in an upper space of the upper casing portion to store and supply the liquid being applied, and a plurality of guides, arranged side by side within the single lower casing portion, for feeding the liquid from the tank to the single channel of the trap; and an operation unit configured to position the trap on the objective region and bring the linearly appeared liquid at the trap into contact with the objective region, thereby linearly applying the liquid to the objective region; and wherein the plurality of guides are respectively configured to apply equal flow resistance to said liquid by forming said each one guide of the plurality of guides side by side spaced apart at a regular interval, said each one guide having a uniform cylindrical shape, a common height and a common diameter; and wherein said each one guide has a first opening facing onto and communicating with the tank at a first end of said one guide to form a plurality of first openings corresponding to the plurality of guides which plurality of first openings are arranged at said regular interval, said first opening of said each one guide linearly extending to a second opening at a second end opposite the first end, to form a corresponding plurality of second openings corresponding to the plurality of guides, which plurality of second openings are arranged at said regular interval, said each one second opening facing onto and communicating with the single channel of the trap; and wherein said opening of single channel of the trap has an annular shape between an inner annular edge at the lower surface of the lower casing portion and an outer annular edge at the lower surface of the lower casing portion, wherein said outer annular edge occurs closer to a periphery of the lower surface of the lower casing portion than the inner annular edge and wherein said plurality of second openings are distributed along an entire course of the annular shape between said inner annular edge and said outer annular edge.

15. The liquid application apparatus of claim 14, wherein all liquid to be applied that is stored in the tank enters the trap only through said plurality of guides.

16. The liquid application apparatus of claim 14, wherein the operation unit brings a dangling part of the liquid, which is linearly trapped in the channel and dangles from the opening, into contact with the objective region, thereby linearly applying the liquid to the objective region.

* * * * *